US009723408B2

(12) United States Patent
Park et al.

(10) Patent No.: US 9,723,408 B2
(45) Date of Patent: Aug. 1, 2017

(54) ELECTRONIC DEVICE AND METHOD OF PREVENTING ERRONEOUS RECOGNIZING INSERTING CONNECTOR INTO EARPHONE JACK

(71) Applicant: Samsung Electronics Co., Ltd., Gyeonggi-do (KR)

(72) Inventors: Seonguk Park, Daegu (KR); Choonho Kim, Daegu (KR); Soonsang Park, Daegu (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/165,799

(22) Filed: May 26, 2016

(65) Prior Publication Data

US 2016/0380394 A1 Dec. 29, 2016

(30) Foreign Application Priority Data

Jun. 24, 2015 (KR) ..... 10-2015-0090023

(51) Int. Cl.

| | |
|---|---|
| ***H04R 1/10*** | (2006.01) |
| ***H04R 5/04*** | (2006.01) |
| *H01R 24/58* | (2011.01) |
| *H01R 105/00* | (2006.01) |
| *H01R 13/66* | (2006.01) |

(52) U.S. Cl.

CPC ..... *H04R 5/04* (2013.01); *H01R 13/665* (2013.01); *H01R 24/58* (2013.01);
(Continued)

(58) Field of Classification Search

CPC ..... H04R 5/033; H04R 5/04; H04R 1/1041; H04R 1/1016; H04R 2420/05;
(Continued)

(56) References Cited

U.S. PATENT DOCUMENTS 6,069,960 A * 5/2000 Mizukami ..... H04R 5/04 381/120
8,655,007 B2 * 2/2014 Hansson ..... H04R 1/1033 381/384

(Continued)

FOREIGN PATENT DOCUMENTS

KR 1020030084421 11/2003

*Primary Examiner* — Xu Mei
(74) *Attorney, Agent, or Firm* — The Farrell Law Firm, P.C.

(57) ABSTRACT

An electronic device includes a circuit electrically connected to first and second contacts and a processor electrically connected to the circuit, wherein the circuit compares a first signal occurring by an electrical contact of the first contact and the external material with a first threshold value to generate a first comparison signal, compares a second signal occurring by an electrical contact of the second contact and the external material with a second threshold value to generate a second comparison signal, and generates a third signal based on a portion of the first and second comparison signals and provides the third signal to the processor, wherein the external material includes one of moisture and a foreign substance or the external connector, and the processor prevents recognizing a contact of the moisture or the foreign substance as a contact of the external connector based on a portion of the third signal.

20 Claims, 11 Drawing Sheets

(52) U.S. Cl.
CPC ..... *H01R 2105/00* (2013.01); *H04R 2420/05* (2013.01); *H04R 2420/09* (2013.01)

(58) Field of Classification Search
CPC ..... H04R 2420/07; H04R 2420/09; H01R 24/58; H01R 2101/00; H01R 2103/00; H01R 2105/00; H01R 2107/00; H01R 13/665; H01R 13/6683; H01R 13/719; H01R 13/7195; H01R 13/7197
USPC ..... 381/26, 58, 74, 77, 370, 374, 384; 439/577, 620.07, 620.09, 620.13, 620.21
See application file for complete search history.

(56) References Cited

U.S. PATENT DOCUMENTS

| | | | | |
|---|---|---|---|---|
| 8,861,743 | B2 * | 10/2014 | Pantfoerder | H04M 1/6058 307/125 |
| 9,103,866 | B2 * | 8/2015 | Mehrabi | G01R 31/04 |
| 9,210,500 | B2 * | 12/2015 | Allen | H04R 3/00 |
| 9,538,276 | B2 * | 1/2017 | Yu | H01R 24/58 |
| 2013/0148819 | A1 * | 6/2013 | You | H04R 3/00 381/74 |
| 2013/0158919 | A1 * | 6/2013 | Shah | H04R 5/04 702/64 |
| 2013/0293240 | A1 * | 11/2013 | Seo | H01R 24/58 324/508 |

* cited by examiner

ELECTRONIC DEVICE AND METHOD OF PREVENTING ERRONEOUS RECOGNIZING INSERTING CONNECTOR INTO EARPHONE JACK

PRIORITY

This application claims priority under 35 U.S.C. §119(a) to Korean Patent Application Serial No. 10-2015-0090023, which was filed in the Korean Intellectual Property Office on Jun. 24, 2015, the entire disclosure of which is incorporated herein by reference.

BACKGROUND

1. Field of the Disclosure

The present disclosure generally relates to an electronic device, and more particularly, to an electronic device and method of preventing erroneous recognizing inserting of a connector into an earphone jack.

2. Description of the Related Art

With development of mobile communication and processor technology and users wanting new and various functions, mobile terminal devices have been innovated. Such mobile terminal devices provide several forms of video and audio multimedia functions in addition to general communication functions such as audio communication or message transmission and reception.

A terminal device that provides such a multimedia function may provide audio content to a user through connection to an earphone device. The earphone device may have an earphone plug at one end of a predetermined length of cable, and the terminal device may have an earphone jack structure for connection to the earphone plug. When the user inserts the earphone plug into an earphone jack of the terminal device, a terminal of the earphone plug and pins within the earphone jack are electrically connected, the terminal device may recognize insertion of the earphone plug and transmit an audio signal to the earphone device.

Because of an open earphone jack structure of a conventional terminal device, moisture or a foreign substance may be easily injected into a connector of an earphone jack, and such moisture or a foreign substance may not flow out but continuously remain inside the jack. By installing a plurality of pins within a housing, an earphone jack generally contacts with a corresponding terminal of an earphone plug to be electrically connected to the corresponding terminal. As described above, when moisture or a foreign substance is injected into the connector, a leakage current occurs between internal pins that maintain a predetermined quantity of constant voltage and thus a phenomenon may occur that a voltage of a specific pin is abnormally floated.

Even when a foreign substance besides the earphone plug is inserted into the earphone jack, such abnormal voltage floating may enable the terminal device to erroneously recognize that an earphone device is inserted in the jack and to erroneously operate.

SUMMARY

The present disclosure has been made in view of the above problems and provides an electronic device and a method of preventing erroneously recognizing that an earphone is inserted into a jack, when moisture or a foreign substance is injected into the earphone jack of the electronic device.

In accordance with an aspect of the present disclosure, an electronic device includes a housing, an opening formed at one surface of the housing and a hole connected thereto, a connector disposed within the hole and including a first contact and a second contact, a circuit electrically connected to the first contact and the second contact, and a processor electrically connected to the circuit, wherein the circuit compares a first signal that has occurred by an electrical contact of the first contact and the external material with a first threshold value to generate a first comparison signal, compares a second signal that has occurred by an electrical contact of the second contact and the external material with a second threshold value to generate a second comparison signal, and generates a third signal based on at least a portion of the first comparison signal and the second comparison signal and provides the third signal to the processor, wherein the external material includes at least one of moisture and a foreign substance or the external connector, and the processor prevents recognizing a contact of the moisture or the foreign substance as a contact of the external connector based on at least a portion of the provided third signal.

In accordance with another aspect of the present disclosure, a method of preventing erroneous recognizing inserting of a connector into an earphone jack includes generating a first comparison signal by comparing a first signal that has occurred by an electrical contact of a first contact provided in a connector and an external material with a first threshold value, generating a second comparison signal by comparing a second signal that has occurred by an electrical contact of a second contact provided in the connector and the external material with a second threshold value, generating a third signal based on at least a portion of the first comparison signal and the second comparison signal, and determining whether the external material is at least one of moisture, a foreign substance and the external connector based on the third signal.

BRIEF DESCRIPTION OF THE DRAWINGS

The aspects, features, and advantages of the present disclosure will be more apparent from the following detailed description taken in conjunction with the accompanying drawings, in which.

DETAILED DESCRIPTION

Figure 1:
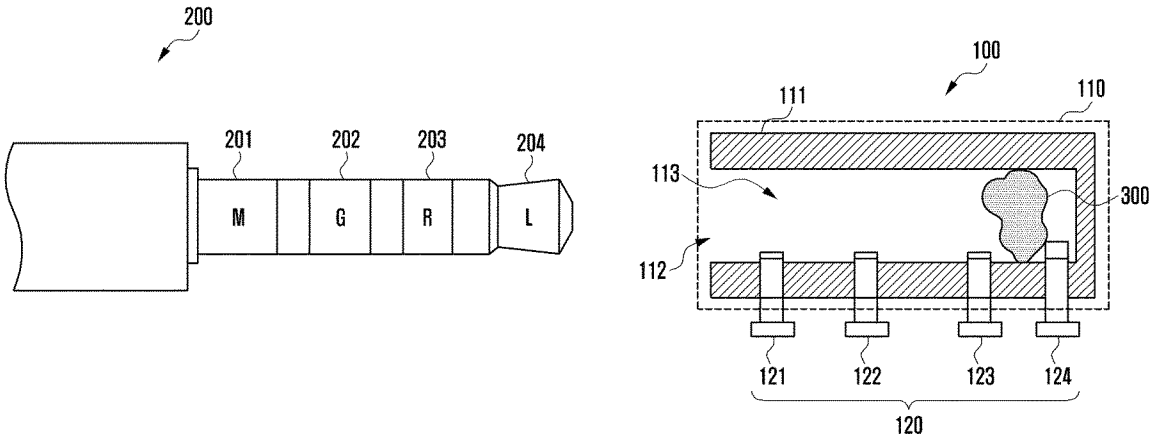
FIG. 1 is a diagram illustrating an earphone jack structure and a plug of an earphone device of an electronic device according to various embodiments of the present disclosure.

Hereinafter, various embodiments of the present disclosure will be described in detail with reference to the accompanying drawings. The present disclosure may be modified in various forms and include various embodiments, but specific examples are illustrated in the drawings and described in the Detailed Description. However, the description does not limit the present disclosure to the specific embodiments, and it shall be appreciated that all the changes, equivalents and substitutions belonging to the idea and technical scope of the present disclosure are included in the present disclosure. In describing the drawings, similar reference numerals are used to designate similar elements.

The terms "include" or "may include" refer to the existence of a corresponding disclosed function, operation or component which may be used in various embodiments of the present disclosure and do not limit one or more additional functions, operations, or components. In the present disclosure, terms such as "include" or "have" may be construed to denote a certain characteristic, number, step, operation, constituent element, component or a combination thereof, but do not exclude the existence of, or a possibility of, addition of one or more other characteristics, numbers, steps, operations, constituent elements, components or combinations thereof.

The term "or" as used in various embodiments of the present disclosure includes any or all of combinations of listed words. For example, the expression "A or B" may include A, may include B, or may include both A and B.

The expressions "1", "2", "first", or "second" used in various embodiments of the present disclosure may modify various components of various embodiments but does not limit the corresponding components. For example, the above expressions do not limit the sequence and/or importance of the elements. The above expressions are used merely for the purpose of distinguishing an element from the other elements. For example, without departing from the scope of the present disclosure, a first component element may be referred to as a second component element. Similarly, the second component element also may be referred to as the first component element.

The terms in various embodiments of the present disclosure are used to describe a specific embodiment, and do not limit the present disclosure. As used herein, the singular forms are intended to include the plural forms as well, unless the context clearly indicates otherwise.

Unless defined differently, all terms used herein, which include technical terms or scientific terms, have the same meaning as those understood by a person skilled in the art to which the present disclosure belongs. Such terms as those defined in a generally used dictionary are to be interpreted to have the same meanings as the contextual meanings in the relevant field of art, and are not to be interpreted to have ideal or excessively formal meanings unless clearly defined in the present disclosure.

An electronic device according to various embodiments of the present disclosure may have a battery and display various content by receiving power from the battery. For example, the electronic device may include at least one of a smart phone, a tablet personal computer (PC), a mobile phone, a video phone, an e-book reader, a desktop PC, a laptop PC, a netbook computer, a PDA, a portable multimedia player (PMP), an MP3 player, a mobile medical device, a camera, a wearable device (for example, a head-mounted-device (HMD) such as electronic eyeglasses, electronic clothes, an electronic bracelet, an electronic necklace, an electronic appcessory, an electronic tattoo, and a smart watch.

According to an embodiment of the present disclosure, the electronic device may be a smart home appliance that has a battery and displays various content by receiving power from the battery. The smart home appliance may, for example, include at least one of a television, a digital video disk (DVD) player, an audio player, an electronic dictionary, and a camcorder.

According to an embodiment of the present disclosure, the electronic device may include at least one of various medical devices (e.g., a magnetic resonance angiography (MRA), a magnetic resonance imaging (MRI), a computed tomography (CT) machine, and an ultrasonic machine), navigation devices, global positioning system (GPS) receivers, event data recorders (EDR), flight data recorders (FDR), vehicle infotainment devices, electronic devices for ships (e.g., navigation devices for ships, and gyro-compasses), avionics, security devices, automotive head units, robots for home or industry, automatic teller machines (ATMs), point of sales (POS) terminals, and Internet of Things (IoT) devices.

According to an embodiment of the present disclosure, the electronic device may include at least one of furniture or a part of a building/structure, an electronic board, an electronic signature receiving device, a projector, and various types of measuring devices (e.g., a water meter, an electricity meter, a gas meter, a radio wave meter, etc.), which has a battery and displays various content by receiving power from the battery. An electronic device may be a combination of one or more of above described various devices. An electronic device may be a flexible device. An electronic device is not limited to the above described devices.

FIG. 1 is a diagram illustrating an earphone jack structure and a plug of an earphone device of an electronic device according to various embodiments of the present disclosure.

As shown in FIG. 1, in the plug of the earphone device 200 and the electronic device 100, only a portion that physically and/or electrically contacts with the plug of the earphone device 200 is illustrated, and it is assumed that a foreign substance is inserted into (or contacts with) an earphone jack receiver 110 of the electronic device 100. Further, FIG. 1 and other drawings illustrate a plug of a known earphone device using a 4-way terminal and an earphone jack structure of the electronic device, but the illustration is only an embodiment of the present disclosure and an earphone device using a 3-way terminal or other forms of a terminal or an electronic device having other structures belong to the scope of the present disclosure.

Referring to FIG. 1, the plug of the earphone device 200 includes a microphone terminal 201, ground terminal 202, right terminal 203, and left terminal 204. When the earphone device 200 is inserted into the earphone jack receiver 110 of the electronic device 100, the terminals 201 to 204 may physically and/or electrically contact with pins 121 to 124, respectively, of the electronic device 100.

In order to insert the plug of the earphone device 200, the electronic device 100 according to various embodiments of the present disclosure has a housing 111, opening 112 formed at one surface of the housing 111, and hole 113 connected to the opening 112, and the opening 112 and the hole 113 may be formed in a cylindrical structure. The opening 112 and the hole 113 may form the earphone jack receiver 110 of the electronic device 100.

At one side surface of the hole 113, at least one pin that contacts with each terminal of the plug of the earphone device 200 may be disposed. Hereinafter, in order to house a 3-way or 4-way earphone device, it is illustrated that the electronic device 100 has four pins, but the number of pins and structure of the earphone jack receiver 110 of the electronic device 100 is not limited thereto.

When the electronic device 100 has four pins, the four pins correspond to a microphone (MIC) pin 121, ground pin 122, right pin 123, and left pin 124, respectively, and when the plug of the earphone device 200 is inserted, the pins may contact with the microphone terminal 201, the ground terminal 202, the right terminal 203, and the left terminal 204. For a direct contact with each terminal of the earphone device 200, at least a portion of each of the pins 121 to 124 may protrude at a predetermined gap within the hole 113 of the housing 111.

As shown in FIG. 1, the four pins 121 to 124 form a portion of a connector 120 to be described later and may be electrically connected to other pins of the connector 120 and/or a circuit of the electronic device 100 to be described later.

The earphone jack receiver 110 is provided with an opening at an outer surface of the electronic device 100, and moisture or a foreign substance 300 may be unintentionally inserted into the earphone jack receiver 110. When the moisture or the foreign substance contacts with the earphone jack receiver 110, the moisture or the foreign substance may have an electrical conductivity property which generates a leakage current between internal pins and maintains a predetermined quantity of constant voltage, thereby causing a voltage of a specific pin to be abnormally floated. Here, a floating voltage is a voltage value of a specific pin that may not be estimated because the voltage value of the specific pin can be changed whenever measuring the voltage value regardless of a connected power source or terminal. Such voltage floating may provide false information to a processor 140 that determines insertion of the earphone device 200 and cause erroneous recognition that the earphone device 200 is inserted.

In the present embodiment, a configuration of a circuit and a processor to be described later may prevent the above erroneous recognition.

Figure 2:
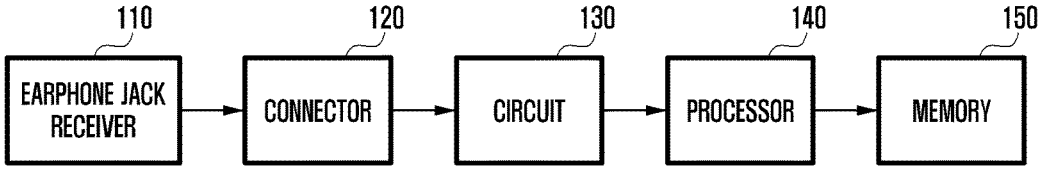
FIG. 2 is a block diagram illustrating a configuration of an electronic device according to various embodiments of the present disclosure.

FIG. 2 is a block diagram illustrating a configuration of an electronic device according to an embodiment of the present disclosure.

Referring to FIG. 2, the electronic device 100 includes an earphone jack receiver 110, connector 120, circuit 130, processor 140, and memory 150.

The earphone jack receiver 110 includes a housing 111, opening 112 formed at one surface of the housing 111, and a hole 113 connected to the opening 112. A detailed structure of the earphone jack receiver 110 has been already described with reference to FIG. 1.

Figure 3:
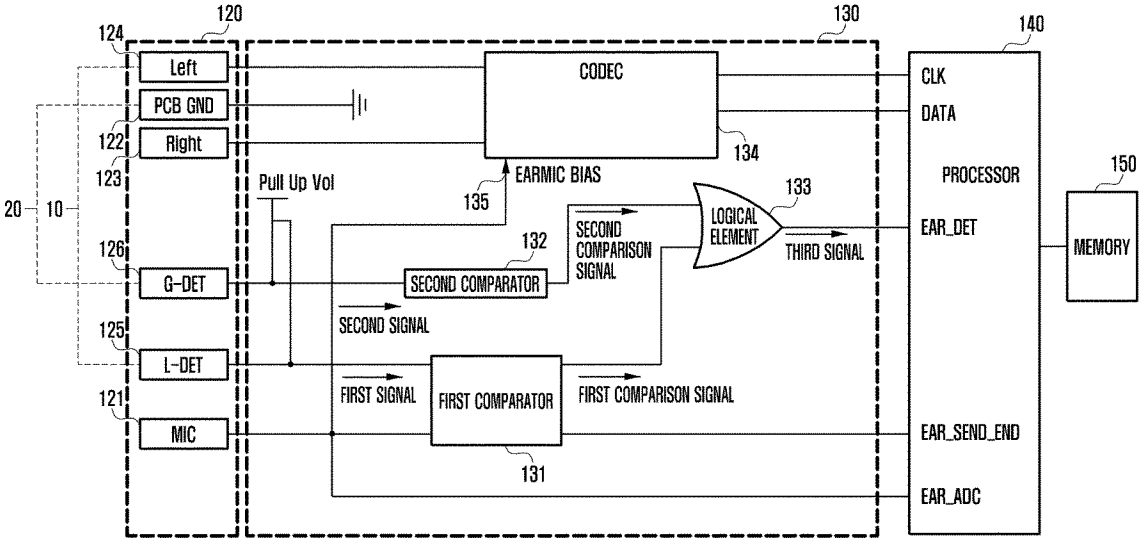
FIG. 3 is a diagram illustrating a configuration of an electronic device according to various embodiments of the present disclosure.

Referring to FIGS. 2 and 3, the connector 120 is disposed within the hole 113 of the earphone jack receiver 110, and when an external material (an external connector, moisture, or a foreign substance) is inserted, the connector 120 may physically contact with the external material. The connector 120 includes a MIC pin 121, ground pin 122, right pin 123, and left pin 124 and may include a ground detection pin (G-DET pin) 126 and a left detection pin (L-DET pin) 125 for detection of the external material. Here, the L-DET pin 125 may be directly connected (or short-circuited) to the left pin 124, and the G-DET pin 126 may be directly connected (or short-circuited) to the ground pin 122.

In the pins of the connector 120, the left pin 124 that forms a contact surface according to insertion of the external material and the L-DET pin 125 connected to the left pin 124 may form a first contact, and the ground pin 122 and the G-DET pin 126 connected to the ground pin 122 may form a second contact. The first contact and the second contact form a first signal and a second signal, respectively, according to a contact of the external material, and here, the first signal and the second signal are electric signals having a predetermined voltage and may have different voltages according to the kind of contact external material.

Referring to FIG. 3, the circuit 130 receives a first signal and second signal that have occurred in the connector 120 and may include a circuit configuration that prevents an erroneous operation of the processor 140 due to the external material. More specifically, the circuit 130 may compare a first signal that has occurred by an electrical contact of the first contact and the external material with a first threshold value to generate a first comparison signal, compare a second signal that has occurred by an electrical contact of the second contact and the external material with a second threshold value to generate a second comparison signal, generate a third signal based on at least a portion of the first comparison signal and the second comparison signal, and provide the third signal to the processor 140.

For such operation as described above, the circuit 130 may include a first comparator 131, a second comparator 132, and a logical element 133. Further, the circuit 130 may further include a known circuit configuration for detecting the external material and transmitting audio signals left and right to the earphone device 200. FIGS. 3 to 6 illustrate a circuit configuration of the electronic device 100 according to various embodiments of the present disclosure and this will be described in detail later.

The processor 140 may be included in an application processor (AP) that drives an operation system and an application program to control each hardware or software component of the electronic device 100 and performs various data processing and calculation functions and is not limited in detailed implementation. The processor 140 performs a function of providing an audio file stored therein or an audio signal received with a streaming method from the outside to the earphone device 200, detects a contact of the external material and the kind of contact external material, and may include instructions for performing such a process. In the present specification, a description of already known functions of various functions of the processor 140 performed for the control of the electronic device 100 will be omitted, and operation of the processor 140 for preventing a contact of moisture or a foreign substance from being erroneously recognized as a contact of the external connector will be described in detail.

The processor 140 may include instructions that receive a third signal output from the circuit 130 and that prevent a contact of moisture or a foreign substance from being recognized as a contact of the external connector based on at least a portion of the received third signal.

The memory 150 may include an operation table for determining an instruction executed in the processor 140 and the kind of external material. The memory 150 may be connected to the processor 140 and/or other constituent elements of the electronic device 100 through various interfaces and may include a known volatile or nonvolatile memory. When interruption related to a contact of the external material occurs, the processor 140 may load an instruction stored at the memory 150 and determine whether the contact external material is at least one of moisture and a foreign substance or the external connector with reference to the received third signal and an operation table stored at the memory 150.

FIG. 3 is a diagram illustrating a configuration of an electronic device according to an embodiment of the present disclosure.

Similarly to a description of FIG. 2, the electronic device 100 includes a connector 120, circuit 130, processor 140, and memory 150, and hereinafter, a more detailed circuit configuration, a flow of an electrical signal according to a contact of an external material, and operation of the processor 140 will be described with reference to FIG. 3. Hereinafter, a voltage value representing a magnitude of each signal and a threshold value is only an embodiment and it will become apparent to a person of ordinary skill in the art that the voltage value may be differently designed according to a detailed circuit configuration.

The processor 140 may include a CLK pin, DATA pin, EAR_DET pin, EAR SEND_END pin, and EAR_ADC pin. The CLK pin and the DATA pin transmit a control signal and a data signal related to an audio signal between the processor 140 and the coder decoder (CODEC) 134. The EAR SEND_END pin receives a SEND key or an END key occurring by switching of a manipulation button of the earphone device 200 to perform a SEND or END interruption. The EAR_ADC pin recognizes an ADC value according to a manipulation of the earphone device 200 and performs a function of determining a corresponding key operation and a function of determining whether the earphone device 200 is an earphone device having a 3-way terminal or a 4-way terminal.

The EAR_DET pin determines whether the earphone device 200 is inserted, and when the earphone device 200 is inserted, the EAR_DET pin enables the electronic device 100 to perform operations (e.g., speaker output interruption and audio signal output path conversion, and earphone insertion display on a screen) corresponding to insertion. According to various embodiments of the present disclosure, when moisture or a foreign substance is inserted into the earphone jack receiver 110, the electronic device 100 includes constituent elements for detecting insertion of the moisture or the foreign substance, and a signal (e.g., third signal) for detecting insertion of moisture or a foreign substance may be received by an EAR_DET pin of the processor 140.

The connector 120 may include a MIC pin 121, ground pin 122 (or PCB GND pin), right pin 123, left pin 124, L-DET pin 125, and G-DET pin 126.

The left pin 124 and the right pin 123 receive an audio signal, and an audio signal output from the processor 140 is decoded in the CODEC 134 to be transmitted to the left pin 124 and the right pin 123, respectively. The CODEC 134 is connected to the processor 140 with a CLK line and a DATA line to receive a clock signal and a data signal.

The MIC pin 121 performs a function of transferring an audio signal input through a microphone of the earphone device 200 to the processor 140. The MIC pin 121 is connected to a MIC BIAS 135, and when it is determined that the external connector is inserted into the electronic device 100, the processor 140 controls a bias voltage (e.g., 2.8V) to be applied from the MIC BIAS 135 to the MIC pin 121, and as the bias voltage is provided, the MIC pin 121 normally operates to receive an audio signal.

The L-DET pin 125 and the G-DET pin 126 detect a contact of an external material, are connected to the left pin 124 and the ground pin 122, respectively, and output a detection signal upon a contact of the external material. When contacting with the external material, the L-DET pin 125 is connected to the left pin 124 to form a first contact 10, and the G-DET pin 126 is connected to the ground pin 122 to form a second contact 20.

At the output of the L-DET pin 125 and the G-DET pin 126, a pull-up voltage is provided, and a predetermined magnitude of pull-up voltage (e.g., 2.8V) may be applied to a node between the L-DET pin 125 and the first comparator 131 and a node between the G-DET pin 126 and the second comparator 132.

The L-DET pin 125 generates a first signal by an electrical contact of an external material, and the first signal is output to the first comparator 131. The first comparator 131 compares the received first signal with a predetermined first threshold value Vref1 to output a first comparison signal. When the external material does not contact, the L-DET pin 125 maintains a voltage close to a pull-up voltage of 1.8V, and this may be defined as a logic state high. Thereafter, when the external material contacts, a voltage of the L-DET pin 125 drops to a ground level and thus the first signal represents a value close to 0V, and this may be defined to a logic state low.

The first comparator 131 compares a first signal with a first threshold value (e.g., 1.4V), and if a first signal is larger than a first threshold value, the first comparator 131 may output a first comparison signal representing a logic state high, and if a first signal is less than or equal to a first threshold value, the first comparator 131 may output a first comparison signal representing a logic state low. That is, when the external material does not contact, the first signal has a value close to a pull-up voltage (1.8V) to be higher than a first threshold value 1.4V and thus the first comparison signal may represent a logic state high, and when the external material contacts, the first signal has a value close to a ground level 0V which is lower than the first threshold value 1.4V and thus the first comparison signal may represent a logic state low.

The G-DET pin 126 may generate a second signal by an electrical contact of the external material. Similarly to the L-DET pin 125, when an external material does not contact, the G-DET pin 126 maintains a logic state high, i.e., a voltage close to a pull-up voltage (1.8V) by the pull-up voltage, and this may be defined as a logic state high. Thereafter, when the external material contacts, a voltage of the G-DET pin 126 drops to a ground level and thus a second signal represents a value close to 0V, and this may be defined as a logic state low.

The logical element 133 may receive a first comparison signal and a second comparison signal from the first comparator 131 and the second comparator 132, respectively, and generate a third signal based on at least a portion of the first comparison signal and the second comparison signal. The logical element 133 may be implemented with a logical element such as a logical OR element, a logical exclusive OR (XOR) element, and a logical AND element that generate a new logic value from the first comparison signal and the second comparison signal. According to various embodiments of the present disclosure, the logical element 133 is implemented with a logical OR element (or OR gate) that performs an OR calculation to output an output value to the processor 140 with a third signal through an OR calculation of the first comparison signal and the second comparison signal.

When the logical element 133 is implemented with a known logic circuit that performs an OR calculation, if each of the input first comparison signal and second comparison signals is high/high, high/low, and low/high, the logical element 133 may generate a third signal representing high, and when the first comparison signal and the second comparison signal each are low/low, the logical element 133 may generate a third signal representing low. Hereinafter, unless stated otherwise, a case in which the logical element 133 is implemented with an OR gate that performs an OR calculation will be described, but this is only an example, and another form of logical element including an AND gate and an XOR gate may be used and thus even if a third signal is output from the first comparison signal and the second comparison signal, the processor may be prevented from erroneously recognizing an external material.

The processor 140 may execute instructions that receives a third signal and that determines whether an external material is inserted based on at least a portion of the third signal and that determines whether the inserted external material is at least one of moisture and a foreign substance or an appropriate external connector. When the third signal is input, the processor 140 determines whether the inserted external material is at least one of moisture and a foreign substance or the external connector by referencing an operation table stored at the memory 150, and an operation table is illustrated in Table 1.

TABLE 1

| First comparison signal | Second comparison signal | Third signal | Recognition result |
|---|---|---|---|
| HIGH | HIGH | HIGH | Earphone non-insertion |
| HIGH | LOW | HIGH | Earphone non-insertion |
| LOW | HIGH | HIGH | Earphone non-insertion |
| LOW | LOW | LOW | Earphone normal insertion |

As shown in FIG. 3, the electronic device 100 according to an embodiment of the present disclosure includes the first comparator 131 and the second comparator 132, and by omitting the second comparator 132, when a second signal output from the G-DET pin 126 is directly input to the logical element 133, if a foreign substance or moisture is inserted, voltage floating may occur.

When a foreign substance or moisture is inserted into the earphone jack receiver 110, a short may occur between the G-DET pin 126 and the L-DET pin 125 and the internal pin including a microphone bias, and as described above, when using a pull-up voltage of 1.8V and a microphone bias voltage of 2.8V, in the G-DET pin 126 and the L-DET pin 125, a voltage floating of 0.7V to 1.1V may occur. Here, the range of floating voltages is an experimentally calculated value.

For example, when it is assumed that voltage floating of 0.7V occurs, a second signal generated in the G-DET pin 126 may be input to the logical element 133 and thus the logical element 133 may recognize the second signal as low. Further, a first signal generated in the L-DET pin 125 is input to the first comparator 131, and because a first signal of 0.7V is a value lower than a first threshold value 1.4V, the logical element 133 may recognize the first signal as low. The logical element 133 may output a third signal representing a logic state low to the processor 140 according to an OR calculation, and the processor 140 may determine that the earphone device 200 is inserted according to the third signal.

In this case, the processor 140 may operate microphone bias according to insertion recognition of the earphone device 200 and therefore a voltage of the G-DET pin 126 may rise to about 1.1V. As a voltage of the G-DET pin 126 rises to 1.1V, the logical element 133 may recognize a second signal occurring again in the G-DET pin 126 as high and output a third signal as high.

When a high is received by the third signal, the processor 140 may determine again that the earphone device 200 is not inserted and turn off the microphone bias. When the microphone bias does not operate, a voltage of the G-DET pin 126 decreases again to 0.7V, and the process may be infinitely repeated.

Accordingly, in the processor 140, earphone recognition interruption is quickly switched, and this may cause various erroneous operations such as lock-up of the electronic device 100.

The electronic device 100 according to various embodiments of the present disclosure adds the second comparator 132, and even when moisture or a foreign substance is inserted into the earphone jack receiver 110, the foregoing abnormal earphone recognition interruption may be prevented.

The second comparator 132 may be provided at the output of the G-DET pin 126, and may compare a second signal with a second threshold value Vref2 to output a second comparison signal. More specifically, when the second signal is larger than the second threshold value, the second comparator 132 may output a second comparison signal representing a logic state high, and when the second signal is less than or equal to the second threshold value, the second comparator 132 may output a second comparison signal representing a logic state low.

A first threshold value, which is a comparison voltage of the first comparator 131 may be set to a value higher than a floating voltage that occurs with a contact of moisture or a foreign substance. Accordingly, when voltage floating occurs, a first comparison signal may represent a logic state low.

A second threshold value, which is a comparison voltage of the second comparator 132 may be set to a value lower than a floating voltage and higher than a ground level with a contact of moisture or a foreign substance. Accordingly, when voltage floating occurs, a second comparison signal may represent a logic state high.

According to various embodiments of the present disclosure, when the earphone device 200 is normally inserted into the earphone jack receiver 110 of the electronic device 100 and when moisture or a foreign substance is inserted into the earphone jack receiver 110 of the electronic device 100, operation of the electronic device 100 is as follows.

Hereinafter, a pull-up voltage is set to 1.8V, and voltage floating range of 0.7V to 1.1V occurs in the L-DET pin 125 and the G-DET pin 126 according to a contact of moisture or a foreign substance, and a case of setting a first threshold value to 1.4V, which is a value higher than the voltage floating and setting a second threshold value to 0.4V, which is a value lower than the voltage floating and higher than a ground level is exemplified.

First, when the earphone jack receiver 110 and the external material do not contact, a first signal and a second signal have a voltage close to a pull-up voltage 1.8V. Because about 1.8V, which is a voltage of the first signal is higher than a first threshold value 1.4V, the first comparator 131 may generate a first comparison signal representing a logic state high, and because about 1.8V, which is a voltage of the second signal is higher than a second threshold value 0.4V, the second comparator 132 may generate a second comparison signal representing a logic state high.

Because each value of the first comparison signal and the second comparison signal is high/high, the logical element 133 may output high to a third signal, and in an operation table, because a state corresponding to the third signal of high corresponds to a state in which a normal external connector is not inserted, the processor 140 may be on standby.

Hereinafter, operation of a case in which the normal earphone device 200 (or the external connector) is inserted into the earphone jack receiver 110 will be described.

When the plug of the earphone device 200 is inserted, a voltage of the L-DET pin 125 and the G-DET pin 126 drops from 1.8V, which is a pull-up level, to a ground level 0V, both the first signal and the second signal may have a value close to 0V.

Because 0V, which is a voltage of a first signal is lower than a first threshold value 1.4V, the first comparator 131 may output a first comparison signal representing a logic state low. Further, because 0V, which is a voltage of a second signal is lower than a second threshold value 0.4V, the second comparator 132 may output a second comparison signal representing a logic state low.

When each value of the first comparison signal and the second comparison signal is low/low, the logical element 133 may output low to a third signal, and the processor 140 may determine a state corresponding to a third signal low in an operation table to a state in which a normal earphone is inserted into the earphone jack receiver 110 to output an earphone insertion signal.

Hereinafter, operation when moisture or a foreign substance is inserted into the earphone jack receiver 110 will be described.

When the external material contacts, voltage floating occurs in the L-DET pin 125 and the G-DET pin 126, and both the first signal and the second signal may have a value range of 0.7V to 1.1V.

Because a value of a first signal is lower than a first threshold value 1.4V, the first comparator 131 may output a first comparison signal representing a logic state low. Further, because a value of a second signal is higher than a second threshold value 0.4V, the second comparator 132 may output a second comparison signal representing a logic state high.

Because each value of the first comparison signal and the second comparison signal is low/high, the logical element 133 may output high to a third signal, and in the operation table, because a state corresponding to the third signal of high corresponds to a state in which the normal external connector 120 is not inserted, the processor 140 may be on standby and not receive an earphone insertion signal.

As described above, when moisture or a foreign substance is inserted, the electronic device 100 according to various embodiments of the present disclosure may be prevented from erroneously recognizing that the external connector 120 is normally inserted. When the external connector 120 is normally inserted, while a voltage of the L-DET pin 125 and the G-DET pin 126 drops from a floating level range (0.7V to 1.1V) to a ground level 0V, both a first signal and a second signal may have a value close to 0V.

Because 0V, which is a voltage of a first signal is lower than a first threshold value 1.4V, the first comparator 131 may output a first comparison signal representing a logic state low. Further, because 0V, which is a voltage of a second signal is lower than a second threshold value 0.4V, the second comparator 132 may output a second comparison signal representing a logic state low.

Because each value of the first comparison signal and the second comparison signal is low/low, the logical element 133 may output low to a third signal, and in the operation table, the processor 140 may determine a state corresponding to the third signal of low to a state in which a normal earphone is inserted into the earphone jack receiver 110 to output earphone insertion signal.

As described above, according to various embodiments of the present disclosure, when moisture or a foreign substance is inserted into the earphone jack receiver, a result value that a normal external connector is not inserted may be output, and the foregoing abnormal interruption switching may be prevented from occurring through a simple circuit configuration.

Figure 4:
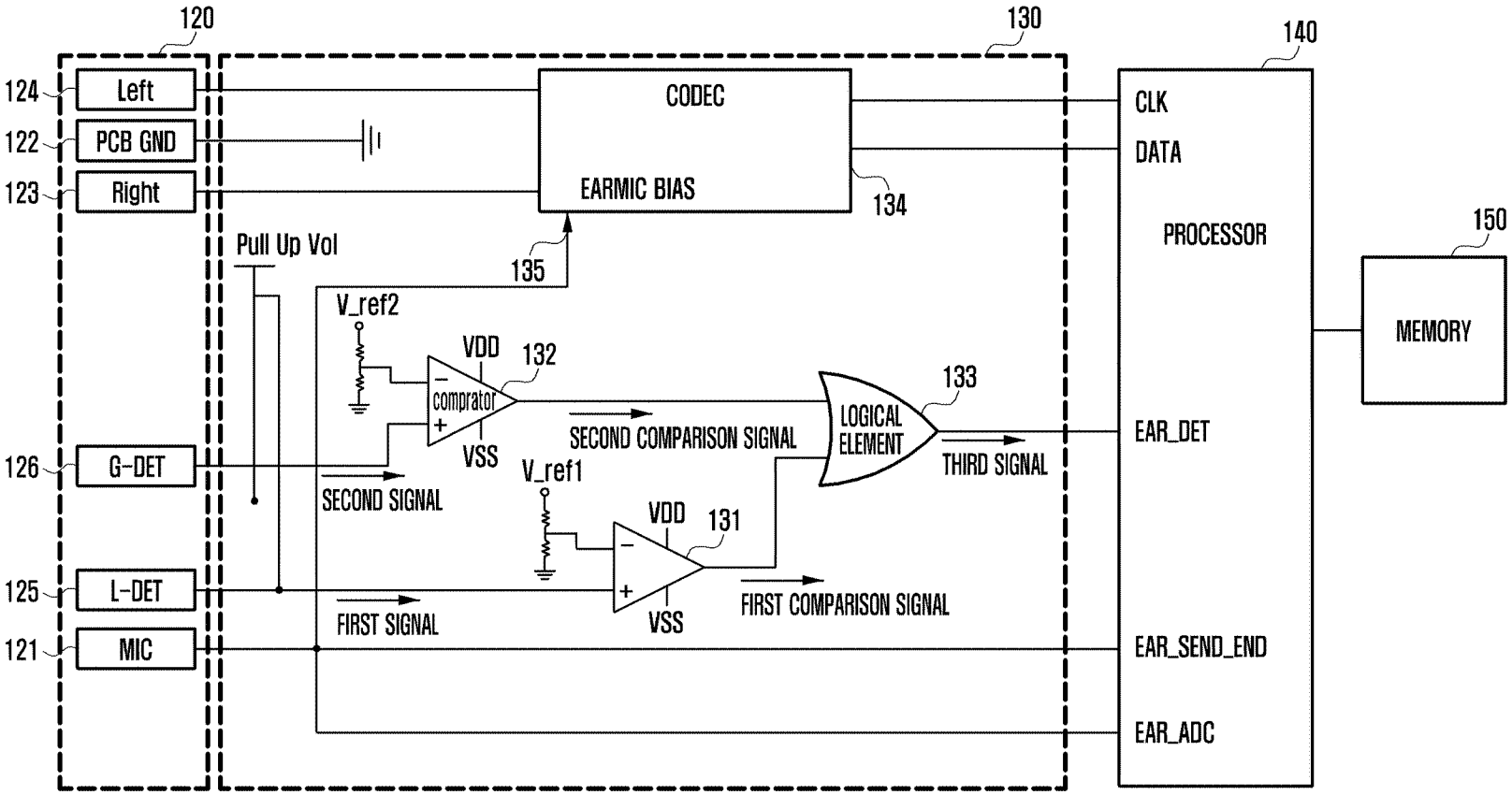
FIG. 4 is a diagram illustrating a configuration of a first comparator and a second comparator in an electronic device according to various embodiments of the present disclosure.

FIG. 4 is a diagram illustrating a configuration of the first comparator and the second comparator in an electronic device according to an embodiment of the present disclosure.

In FIG. 4, elements other than the first comparator 131 and the second comparator 132 are the same as those described with reference to FIG. 3 and therefore a detailed description thereof will be omitted.

A (+) terminal of the first comparator 131 is connected to an L-DET terminal and a first signal is thus input thereto, and a reference voltage Vref1 having a first threshold value (e.g., 1.4V) is input to a (−) terminal. Vdd may be a voltage value of 1.1V or more representing a logic state high, and Vss may be a voltage value of 0.6V or less representing a logic state low. The first comparator 131 compares the input first signal and Vref1, and if the first signal is larger than Vref1, the first comparator 131 outputs Vdd, and if the first signal is less than or equal to Vref1, the first comparator 131 outputs Vss. An output value of the first comparator 131 may be transmitted to the logical element 133 with a third signal.

Further, a (+) terminal of the second comparator 132 is connected to a G-DET terminal and a second signal is thus input thereto, and a reference voltage Vref2 having a second threshold value (e.g., 0.4V) is input to a (−) terminal. Vdd may be a voltage value of 1.1V or more representing a logic state high, and Vss may be a voltage value of 0.6V or less representing a logic state low. The second comparator 132 compares an input second signal and Vref1, and if the second signal is larger than Vref1, the second comparator 132 outputs Vdd, and if the second signal is less than or equal to Vref1, the second comparator 132 outputs Vss. An output value of the second comparator 132 may be transmitted to the logical element 133 with a third signal.

The first comparator 131 and the second comparator 132 may be implemented with a common comparator including an operational amplifier (OP-AMP), but a known circuit configuration that may output a predetermined value according to a comparison result of an input electric signal and a reference value may be implemented with the first comparator 131 and the second comparator 132.

Figure 5:
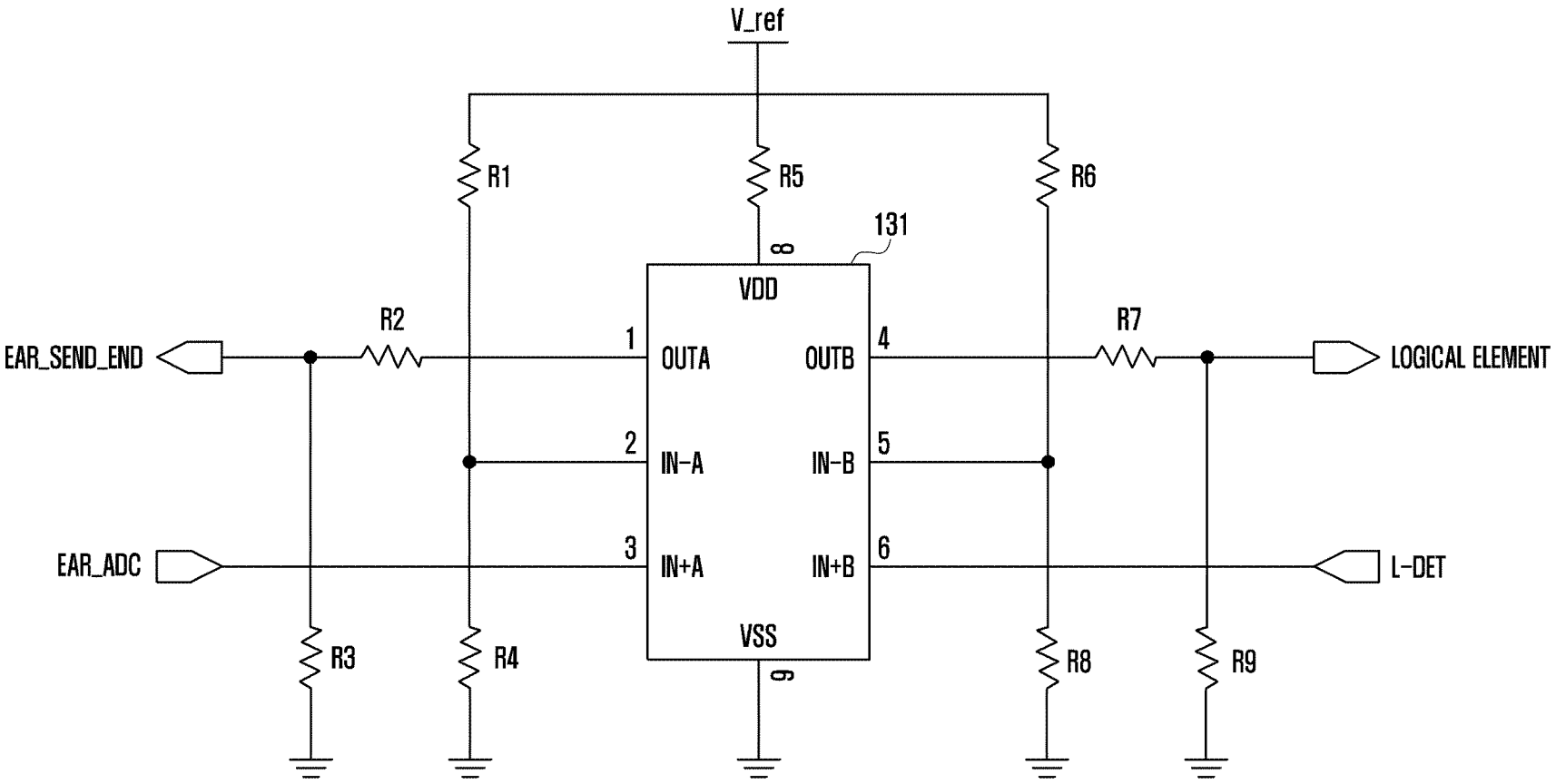
FIG. 5 is a diagram illustrating a circuit configuration including a first comparator according to various embodiments of the present disclosure.

FIG. 5 is a diagram illustrating a circuit configuration including a first comparator according to an embodiment of the present disclosure.

The first comparator 131 may include a Vdd pin to which a reference voltage Vref is input, Vss pin connected to the ground, IN+A pin to which an EAR_ADC value is input, IN−A pin to which a comparison voltage with the EAR_ADC value is input, OUT A pin that compares values of the IN+A pin and the IN−A pin to output a result value, IN+B pin to which an output signal of the L-DET pin 125 is input, IN−B pin to which a comparison voltage (the above first threshold value) with the L-DET value is input, and OUT B pin that compares values of the IN+B pin and the IN−B pin to output a result value.

As shown in FIG. 5, a reference voltage Vref may be distributed by R1, R4, R5, R6, and R8 to be input to the VDD pin, IN−A pin, and IN+A pin. An EAR-ADC value may be input to the IN+A pin, and an output value of the OUT A pin may be distributed by R2 and R3 to be input to the EAR_SEND_END pin. The processor 140 may process SEND or END interruption according to an input value of the EAR_SEND_END pin.

Further, a voltage value of a first threshold value may be input to the IN−B pin according to voltage distribution, and a first signal output from the L-DET pin 125 may be input to the IN+B pin. The first comparator 131 may compare an input value of the IN+B pin and an input value of the IN−B pin to output a result value through the OUT B pin. As described above, when an input value of the IN+B pin is larger than an input value of the IN−B pin, the first comparator 131 may output a Vdd value, and when an input value of the IN+B pin is less than an input value of the IN−B pin, the first comparator 131 may output a Vss value. An output value (or third signal) of the OUT B pin may be distributed by R7 and R8 to be input to the logical element 133. When an output value of the OUT B pin is Vdd, the logical element 133 may determine that a logic state high is input, and when an output value of the OUT B pin is Vss, the logical element 133 may determine that a logic state low is input.

FIG. 5 is an illustration for implementing the present disclosure and a reference voltage Vref value and the resistance values of R1 to R9 are not limited. Further, any of R1 to R9 may be omitted according to a detailed circuit configuration and an additional resistor may be added, as needed.

Figure 6:
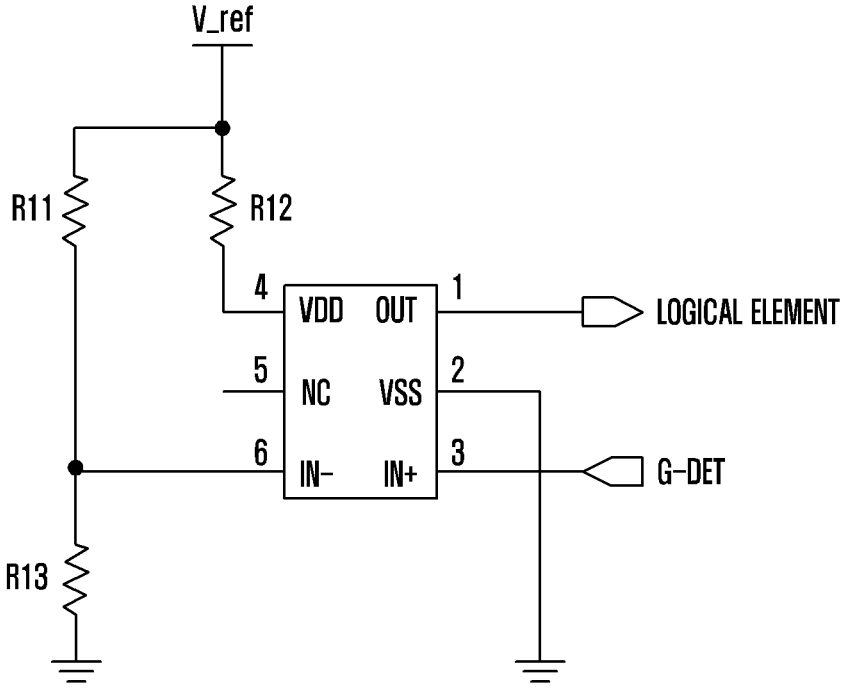
FIG. 6 is a diagram illustrating a circuit configuration including a second comparator according to various embodiments of the present disclosure.

FIG. 6 is a diagram illustrating a circuit configuration including a second comparator according to an embodiment of the present disclosure.

The second comparator 132 may include a Vdd pin to which a reference voltage Vref is input, Vss pin connected to the ground, IN+ pin to which a second signal output from the G-DET pin 126 is input, IN− pin to which a comparison voltage (the above second threshold value) with a G-DET value is input, and OUT pin that compare values of the IN+ pin and the IN− pin to output a result value.

The reference voltage Vref is distributed by resistors R11 and R13/R12 to be input to the Vdd pin and the IN− pin, and a voltage value of the second threshold value may be input to the IN− pin according to voltage distribution. When an input value of the IN+ pin is larger than an input value of the IN− pin, the second comparator 132 may output a Vdd value, and when an input value of the IN+ pin is less than an input value of the IN− pin, the second comparator 132 may output a Vss value. An output value of the OUT pin may be input to the logical element 133. When an output value of the OUT pin is Vdd, the logical element 133 may determine that a logic state high is input, and when an output value of the OUT pin is Vss, the logical element 133 may determine that a logic state low is input.

Figure 7:
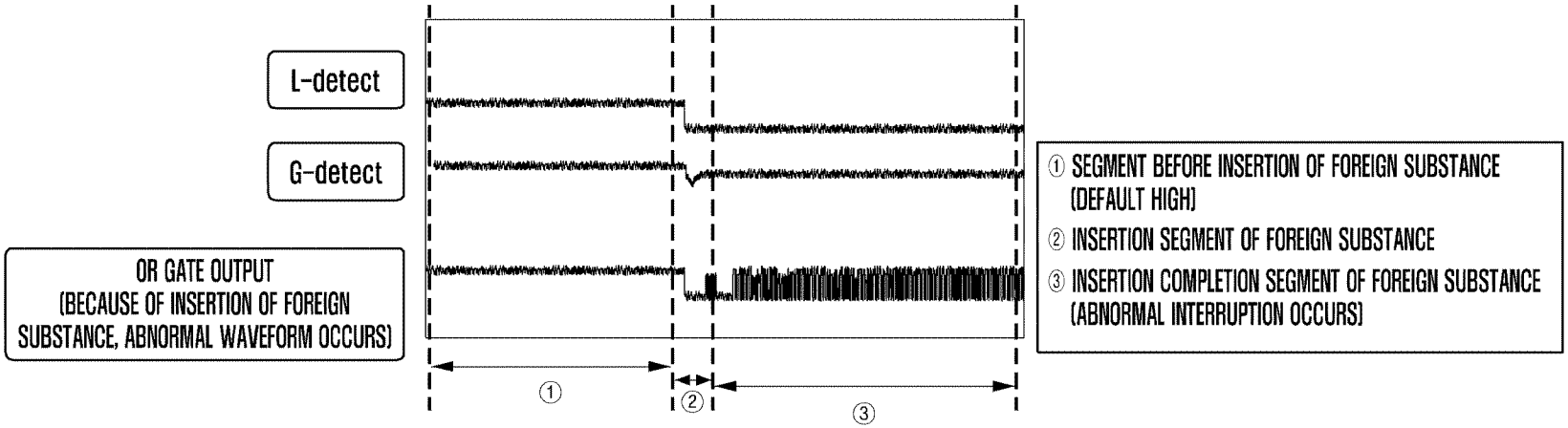
FIG. 7 is a graph illustrating a voltage change of a G-DET pin, an L-DET pin, and a logical element according to various embodiments of the present disclosure.

FIG. 7 is a graph illustrating a voltage change of a G-DET pin, an L-DET pin, and a logical element according to various embodiments of the present disclosure.

FIG. 7 illustrates a voltage change of the L-DET pin 125, the G-DET pin 126, and the logical element 133 in a state in which the second comparator 132 is not formed according to various embodiments of the present disclosure. In FIG. 7, 1 indicates a time period representing a default high voltage before insertion of a foreign substance, 2 indicates a time period in which a foreign substance is inserted, 3 indicates a time period after insertion completion of a foreign substance, and as shown in FIG. 7, after insertion completion of a foreign substance, it may be determined that the logical element 133 is abnormally floated.

Figure 8:
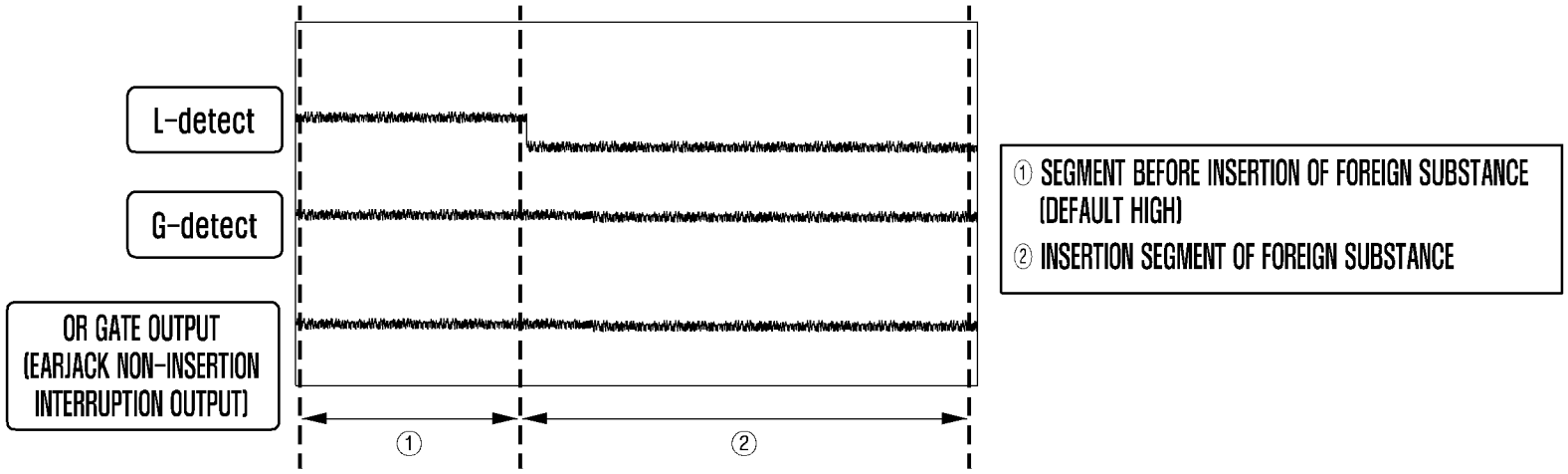
FIG. 8 is a graph illustrating a voltage change of a G-DET pin, an L-DET pin, and a logical element according to various embodiments of the present disclosure.

FIG. 8 is a graph illustrating a voltage change of a G-DET pin, an L-DET pin, and a logical element according to various embodiments of the present disclosure.

As described above, FIG. 8 illustrates a voltage change of the L-DET pin 125, the G-DET pin 126, and the logical element 133 when both the first comparator 131 and the second comparator 132 are formed. In FIG. 8, 1 indicates a time period representing a default high voltage before insertion of a foreign substance, and 2 indicates a time period of a state in which a foreign substance is inserted and a segment after insertion completion of a foreign substance, and as shown in FIG. 8, as an output value of the logical element 133 maintains a stable value like a state before insertion of a foreign substance, it is experimentally determined that the processor 140 may detect a state in which the external connector 120 is not connected.

An electronic device according to various embodiments of the present disclosure includes a housing, an opening formed at one surface of the housing and a hole connected thereto, a connector disposed within the hole and including a first contact and a second contact, a circuit electrically connected to the first contact and the second contact, and a processor electrically connected to the circuit, wherein the circuit compares a first signal that has occurred by an electrical contact of the first contact and the external material with a first threshold value to generate a first comparison signal, compares a second signal that has occurred by an electrical contact of the second contact and the external material with a second threshold value to generate a second comparison signal, and generates a third signal based on at least a portion of the first comparison signal and the second comparison signal and provides the third signal to the processor, wherein the external material includes at least one of moisture and a foreign substance or the external connector, and the processor prevents from recognizing a contact of the moisture or the foreign substance as a contact of the external connector based on at least a portion of the provided third signal.

The opening and the hole may form an earphone jack receiver of the electronic device.

The first contact may electrically contact with a left terminal of the external connector, and the second contact may electrically contact with a GND terminal of the external connector, when the external connector contacts.

The first contact may maintain a pull-up state when the external material does not contact.

The first contact may have a predetermined range of floating voltage, when at least one of the moisture and the foreign substance contacts.

The first contact may have a ground level of voltage, when the external connector contacts.

The circuit may include a first comparator that compares a first signal that outputs from the first contact with a predetermined first threshold value to generate the first comparison signal, and a second comparator that compares a second signal that outputs from the second contact with a predetermined second threshold value to generate the second comparison signal.

The circuit may further include a logical element that receives a first comparison signal generating in the first comparator and a second comparison signal generating in the second comparator and that performs an OR calculation of the first comparison signal and the second comparison signal to generate the third signal.

The processor may determine whether the contact external material is at least one of the moisture and a foreign substance or the external connector according to a logic state of a third signal output from the logical element.

The first threshold value may be set to a value higher than a floating voltage occurring as a result of the moisture or the foreign substance.

The second threshold value may be set to a value lower than a floating voltage occurring as a result of the moisture or the foreign substance.

The first comparator may generate a first comparison signal that defines a logic state high, when the first signal is higher than the first threshold value, the second comparator may generate a second comparison signal that defines a logic state low, when the second signal is lower than the second threshold value, the logical element may receive an input of the first comparison signal and the second comparison signal to generate a third signal that defines a logic state high, and the processor may include an instruction that determines that the external material is at least one of moisture and a foreign substance, when the third signal is in a logic state high.

The first comparator may generate a first comparison signal that defines a logic state low, when the first signal is lower than the first threshold value, the second comparator may generate a second comparison signal that defines a logic state low, when the second signal is lower than the second threshold value, the logical element receives an input of the first comparison signal and the second comparison signal to generate a third signal that defines a logic state low, and the processor executes instructions that determines whether the external material is the external connector, when the third signal is in a logic state low.

The electronic device may further include a memory that stores an operation table that determines a kind of the external material that contacts with the hole according to a logic state of a third signal input to the processor, wherein the processor may execute instructions that determines whether the external material is at least one of the moisture and a foreign substance or the external connector by referencing the operation table, when the third signal is input.

Figure 9:
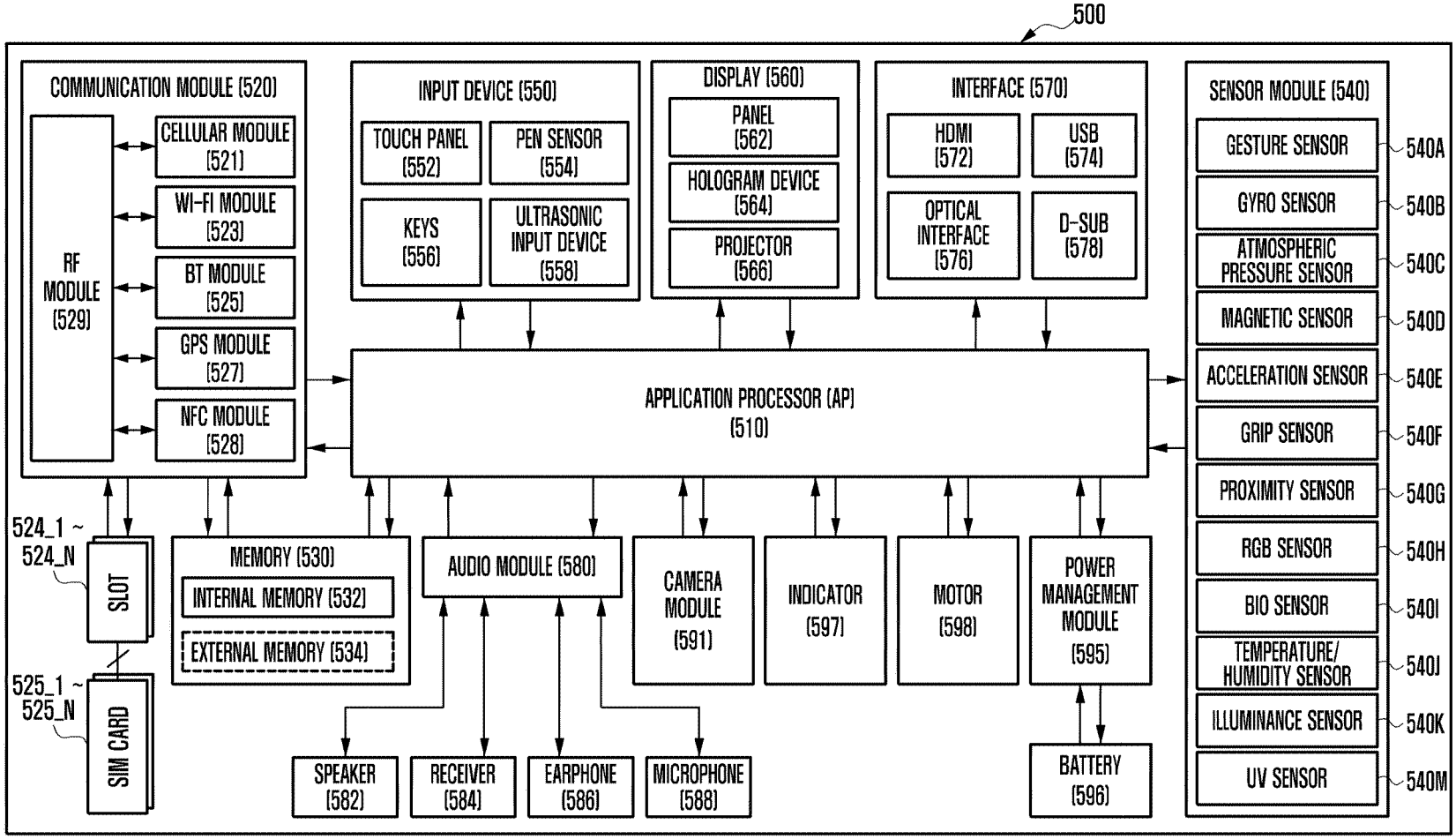
FIG. 9 is a block diagram illustrating a configuration of an electronic device according to various embodiments of the present disclosure.

FIG. 9 is a block diagram illustrating an electronic device according to various embodiments of the present disclosure. The electronic device 500 includes at least one application processor (AP) 510, a communication module 520, a subscriber identification module (SIM) card 525, a memory 530, a sensor module 540, an input device 550, a display 560, an interface 570, an audio module 580, a camera module 591, a power management module 595, a battery 596, an indicator 597, and a motor 598.

The processor 510 may control a plurality of hardware or software components connected to the processor 510 by driving an operating system or an application program and perform processing of various pieces of data and calculations. The processor 510 may be implemented by, for example, a system on chip (SoC). According to an embodiment, the processor 510 may further include a graphic processing unit (GPU) and/or an image signal processor. The processor 510 may include at least some (e.g., a cellular module 521) of the elements illustrated in FIG. 9. The processor 510 may load, into a volatile memory, instructions or data received from at least one (e.g., a non-volatile memory) of the other elements and may execute the loaded instructions or data, and may store various data in a non-volatile memory.

The communication module 520 includes a cellular module 521, a WiFi module 523, a Bluetooth module 525, a GNSS module 527 (e.g., a GPS module, a Glonass module, a Beidou module, or a Galileo module), an NFC module 528, and a radio frequency (RF) module 529.

The cellular module 521 may offer a voice call, a video call, a message service, an Internet access service, and the like through a communication network. Additionally, the cellular module 521 may perform identification and authentication of the electronic device in the communication network, using the SIM card 525. According to an embodiment, the cellular module 521 may perform at least part of functions the AP 510 may provide. The cellular module 521 may include a communication processor (CP).

Each of the WiFi module 523, the BT module 525, the GNSS module 527 and the NFC module 528 may include a processor for processing data transmitted or received. Although FIG. 9 shows the cellular module 521, the WiFi module 523, the BT module 525, the GNSS module 527 and the NFC module 528 as different blocks, at least part of them may be contained in a single IC (integrated circuit) chip or a single IC.

The RF module 529 may transmit and receive data, e.g., RF signals or any other electric signals. The RF module 529 may include a transceiver, a PAM (power amp module), a frequency filter, an LNA (low noise amplifier), an antenna or the like. Although FIG. 9 shows that the cellular module 521, the WiFi module 523, the BT module 525, the GNSS module 527 and the NFC module 528 share the RF module 529, at least one of them may perform transmission and reception of RF signals through a separate RF module in an embodiment.

The SIM card 525 may be inserted into a slot formed at a certain place in the electronic device. The SIM card 525 may contain therein an ICCID (integrated circuit card identifier) or an IMSI (international mobile subscriber identity).

The memory 530 includes an internal memory 532 and an external memory 534. The internal memory 532 may include, for example, at least one of a volatile memory (e.g., DRAM (dynamic RAM), SRAM (static RAM), SDRAM (synchronous DRAM), etc.) or a nonvolatile memory (e.g., OTPROM (one time programmable ROM), PROM (programmable ROM), EPROM (erasable and programmable ROM), EEPROM (electrically erasable and programmable ROM), mask ROM, flash ROM, NAND flash memory, NOR flash memory, etc.).

According to an embodiment, the internal memory 532 may have the form of an SSD (solid state drive). The external memory 534 may include a flash drive, e.g., CF (compact flash), SD (secure digital), micro-SD (micro secure digital), mini-SD (mini secure digital), xD (eXtreme digital), memory stick, and the like.

The external memory 534 may be functionally connected to the electronic device 500 through various interfaces. According to an embodiment, the electronic device 500 may further include a storage device or medium such as a hard drive.

The sensor module 540 may measure physical quantity or sense an operating status of the electronic device 500, and then convert measured or sensed information into electric signals. The sensor module 540 includes a gesture sensor 540A, a gyro sensor 540B, an atmospheric pressure sensor 540C, a magnetic sensor 540D, an acceleration sensor 540E, a grip sensor 540F, a proximity sensor 540G, a color sensor 540H (e.g., RGB (red, green, blue) sensor), a biometric sensor 540I, a temperature-humidity sensor 540J, an illumination sensor 540K, and a UV (ultraviolet) sensor 540M. Additionally or alternatively, the sensor module 540 may include, e.g., an E-nose sensor, an EMG (electromyography) sensor, an EEG (electroencephalogram) sensor, an ECG (electrocardiogram) sensor, an IR (infrared) sensor, an iris scan sensor, or a fingerprint scan sensor. Also, the sensor module 540 may include a control circuit for controlling one or more sensors equipped therein.

The input unit 550 includes a touch panel 552, a digital pen sensor 554, a key 556, or an ultrasonic input unit 558. The touch panel 552 may recognize a touch input in a manner of capacitive type, resistive type, infrared type, or ultrasonic type. Also, the touch panel 552 may further include a control circuit. In case of a capacitive type, a physical contact or proximity may be recognized. The touch panel 552 may further include a tactile layer. In this case, the touch panel 552 may offer a tactile feedback to a user.

The digital pen sensor 554 may be formed in the same or similar manner as receiving a touch input or by using a separate recognition sheet. The key 556 may include, for example, a physical button, an optical key, or a keypad. The ultrasonic input unit 558 is a specific device capable of identifying data by sensing sound waves with a microphone 588 in the electronic device 500 through an input tool that generates ultrasonic signals, thus allowing wireless recognition. According to an embodiment, the electronic device 500 may receive a user input from any external device (e.g., a computer or a server) connected thereto through the communication module 520.

The display 560 (e.g., the display 160) includes a panel 562, a hologram 564, or a projector 566. The panel 562 may be, for example, LCD (liquid crystal display), AM-OLED (active matrix organic light emitting diode), and the like. The panel 562 may have a flexible, transparent or wearable form. The panel 562 may be formed of a single module with the touch panel 552. The hologram 564 may show a stereoscopic image in the air using interference of light. The projector 566 may project an image onto a screen, which may be located at the inside or outside of the electronic device 500. According to an embodiment, the display 560 may further include a control circuit for controlling the panel 562, the hologram 564, and the projector 566.

The interface 570 includes an HDMI (high-definition multimedia interface) 572, a USB (universal serial bus) 574, an optical interface 576, or a D-sub (D-subminiature) 578. Additionally or alternatively, the interface 570 may include, for example, an MHL (mobile high-definition link) interface, an SD (secure digital) card/MMC (multi-media card) interface, or an IrDA (infrared data association) interface.

The audio module 580 may perform a conversion between sounds and electric signals. The audio module 580 may process sound information inputted or outputted through a speaker 582, a receiver 584, an earphone 586, or a microphone 588.

The camera module 591 is a device capable of obtaining still images and moving images. According to an embodiment, the camera module 591 may include at least one image sensor (e.g., a front sensor or a rear sensor), a lens (not shown), an ISP (image signal processor, or a flash (e.g., LED or xenon lamp, not shown).

The power management module 595 may manage electric power of the electronic device 500. The power management module 595 may include, for example, a PMIC (power management integrated circuit), a charger IC, or a battery gauge.

The PMIC may be formed, for example, of an IC chip or SoC. Charging may be performed in a wired or wireless manner. The charger IC may charge a battery 596 and prevent overvoltage or overcurrent from a charger. According to an embodiment, the charger IC may have a charger IC used for at least one of wired and wireless charging types. A wireless charging type may include, for example, a magnetic resonance type, a magnetic induction type, or an electromagnetic type. An additional circuit for a wireless charging may be further used such as a coil loop, a resonance circuit, or a rectifier.

The battery gauge may measure the residual charge amount of the battery 596 and a voltage, current or temperature in a charging process. The battery 596 may store or create electric power therein and supply electric power to the electronic device 500. The battery 596 may be, for example, a rechargeable battery or a solar battery.

The indicator 597 may show thereon a current status (e.g., a booting status, a message status, or a recharging status) of the electronic device 500 or a part (e.g., the AP 510). The motor 598 may convert an electric signal into a mechanical vibration. The electronic device 500 may include a specific processor (e.g., GPU) for supporting a mobile TV. This processor may process media data that comply with standards of DMB (digital multimedia broadcasting), DVB (digital video broadcasting), or mediaFlo™.

Each of the above-discussed elements of the electronic device disclosed herein may be formed of one or more components, and its name may be varied according to the type of electronic device. The electronic device disclosed herein may be formed of at least one of the above-discussed elements without some elements or with additional elements. Some of the elements may be integrated into a single entity that still perform the same functions as those of such elements before integrated.

Figure 10:
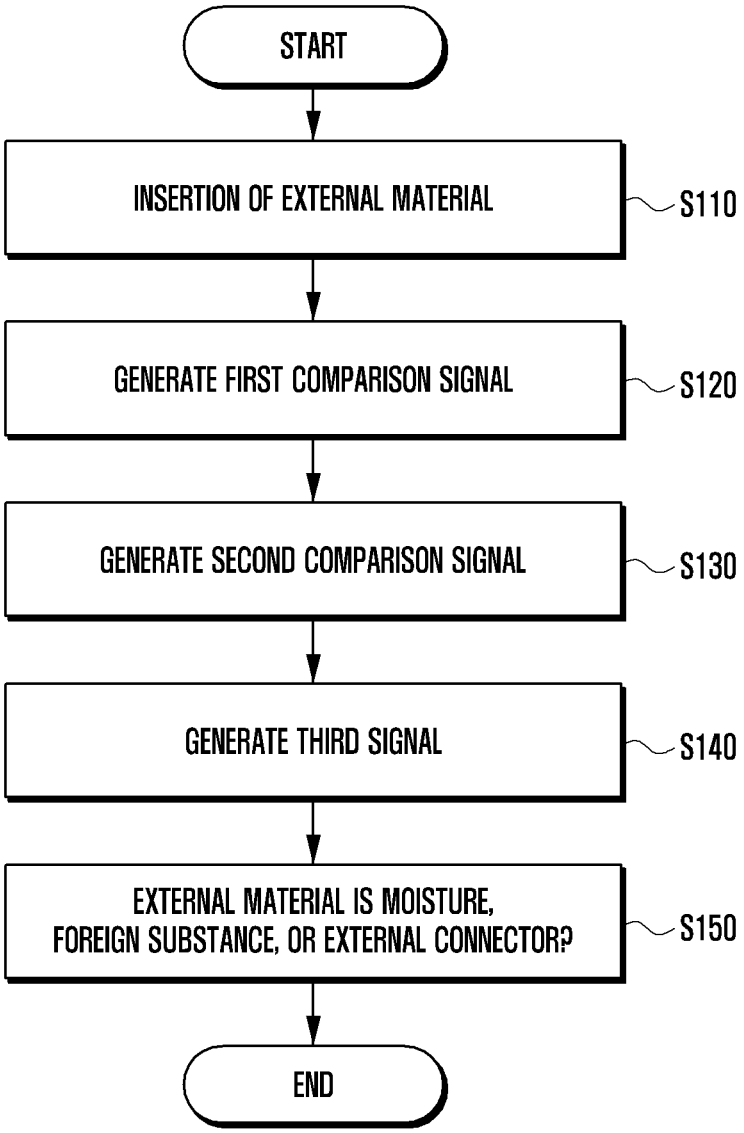
FIG. 10 is a flowchart illustrating a method of preventing erroneous recognizing inserting a connector into an earphone jack according to various embodiments of the present disclosure.

FIG. 10 is a flowchart illustrating a method of preventing erroneously recognizing insertion of a connector into an earphone jack according to various embodiments of the present disclosure.

The method may be performed by the electronic device described with reference to FIGS. 1 to 9 and the foregoing technical description will be omitted hereinafter.

Referring to the flowchart of FIG. 10, an external material is inserted into (or contacts with) the earphone jack receiver of the electronic device at step S110. Here, the external material may include at least one of moisture, a foreign substance, and an external connector.

The electronic device compares a first signal that has occurred by an electrical contact of a first contact provided in the connector and the external material with a first threshold value to generate a first comparison signal at step S120. Here, the first threshold value may be set to a value higher than a floating voltage occurring by moisture or a foreign substance.

The electronic device compares a second signal that has occurred by an electrical contact of a second contact provided in the connector and the external material simultaneously or sequentially generating a first comparison signal with a second threshold value to generate a second comparison signal at step S130. Here, the second threshold value may be set to a value lower than a floating voltage occurring by moisture or a foreign substance.

The electronic device generates a third signal based on at least a portion of the first comparison signal and the second comparison signal at step S140.

The electronic device determines whether the contact external material is at least one of moisture and a foreign substance or the external connector based on the third signal at step S150.

Figure 11:
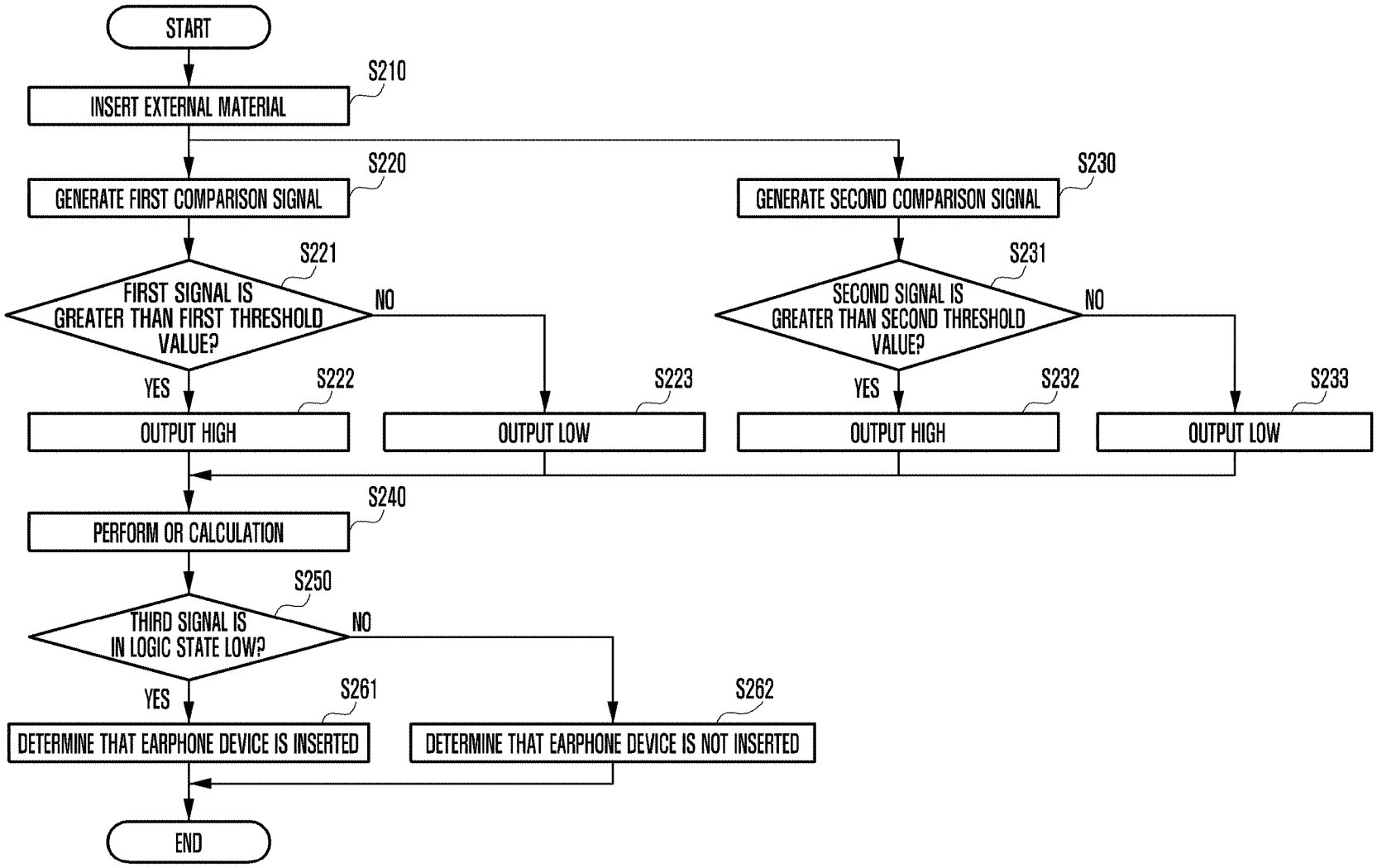
FIG. 11 is a flowchart illustrating another method of preventing erroneous recognizing inserting a connector into an earphone jack according to various embodiments of the present disclosure.

FIG. 11 is a flowchart illustrating another method of preventing erroneously recognizing insertion of a connector into an earphone jack according to various embodiments of the present disclosure.

Referring to the flowchart of FIG. 11, an external material is inserted into the earphone jack receiver of the electronic device at step S210.

When an external material is inserted (or contacts), the electronic device generates a first signal by an electrical contact of a first contact provided in the connector and the external material at step S220. When the first signal occurs, the electronic device compares the first signal with a first threshold value at step S221, and if the first signal is greater than a first threshold value, the electronic device outputs a logic state high at step S222, and if the first signal is lower than a first threshold value, the electronic device outputs a logic state low at step S223. Here, the output high or low signal may correspond to the foregoing first comparison signal.

Simultaneously or sequentially with operation of generating a first signal, the electronic device generates a second signal by an electrical contact of a second contact provided in the connector and an external material at step S230. When the second signal occurs, the electronic device compares the second signal with a second threshold value at step S231, and if the second signal is greater than a second threshold value, the electronic device outputs a logic state high at step S232, and if the second signal is lower than a second threshold value, the electronic device outputs a logic state low at step S233. Here, the output high or low signal may correspond to the foregoing second comparison signal.

The electronic device performs an OR calculation of the first comparison signal and the second comparison signal to generate a third signal at step S240.

The electronic device determines whether the generated third signal is in a logic state low at step S250, and if the generated third signal is in a logic state low, the electronic device determines that an earphone device is inserted at step S261, and if the generated third signal is in a logic state high, the electronic device determines that an earphone device is not inserted at step S262.

A method of preventing erroneously recognizing insertion of a connector into an earphone of an electronic device according to various embodiments of the present disclosure includes generating a first comparison signal by comparing a first signal that has occurred by an electrical contact of a first contact provided in a connector and an external material with a first threshold value, generating a second comparison signal by comparing a second signal that has occurred by an electrical contact of a second contact provided in the connector and the external material with a second threshold value, generating a third signal based on at least a portion of the first comparison signal and the second comparison signal, and determining whether the external material is at least one of moisture and a foreign substance or the external connector based on the third signal.

The first threshold value may be set to a value higher than a floating voltage occurring by the moisture or a foreign substance.

The second threshold value may be set to a value lower than a floating voltage occurring by the moisture or a foreign substance.

Generating a first comparison signal may include generating a first comparison signal that defines a logic state high, when the first signal is higher than the first threshold value, generating a second comparison signal may include generating a second comparison signal that defines a logic state low, when the second signal is lower than the second threshold value, generating a third signal may include generating a third signal that receives an input of the first comparison signal and the second comparison signal to define a logic state high, and determining whether the external material is at least one of moisture and a foreign substance or the external connector may include determining that the external material is at least one of moisture and a foreign substance, when the third signal is in a logic state high.

Generating a first comparison signal may include generating a first comparison signal that defines a logic state low, when the first signal is lower than the first threshold value, generating a second comparison signal may include generating a second comparison signal that defines a logic state low, when the second signal is lower than the second threshold value, generating a third signal may include generating a third signal that receives an input of the first comparison signal and the second comparison signal to define a logic state low, and determining whether the external material is at least one of moisture and a foreign substance or the external connector may include determining that the external material is the external connector, when the third signal is in a logic state low.

Determining whether the external material is at least one of moisture and a foreign substance or the external connector may include determining whether the external material is at least one of the moisture and a foreign substance or the external connector by referencing an operation table stored at a memory.

According to the foregoing various embodiments of the present disclosure, an electronic device may be prevented from erroneously operating by voltage floating resulting from insertion of moisture or a foreign substance into an earphone jack.

As described above, according to an embodiment of the present disclosure, when moisture or a foreign substance is injected into an earphone jack of an electronic device, the electronic device may be prevented from erroneously recognizing that an earphone is inserted.

Although certain embodiments of the present disclosure have been described in detail hereinabove, it should be clearly understood that many variations and modifications of the basic inventive concepts herein described, which may appear to those skilled in the art, will still fall within the spirit and scope of the embodiments of the present disclosure as defined by the appended claims and their equivalents.

What is claimed is:

1. An electronic device, comprising:

a housing;

an opening formed at one surface of the housing and a hole connected thereto;

a connector disposed within the hole and comprising a first contact and a second contact;

a circuit electrically connected to the first contact and the second contact; and a processor electrically connected to the circuit, wherein the circuit compares a first signal that has occurred by an electrical contact of the first contact and an external material with a first threshold value to generate a first comparison signal, compares a second signal that has occurred by an electrical contact of the second contact and the external material with a second threshold value to generate a second comparison signal, and generates a third signal based on at least a portion of the first comparison signal and the second comparison signal and provides the third signal to the processor, wherein the external material comprises at least one of moisture, a foreign substance and an external connector, and the processor is configured to prevent recognizing a contact of the moisture or the foreign substance as a contact of the external connector based on at least a portion of the third signal.

2. The electronic device of claim 1, wherein the opening and the hole form an earphone jack receiver of the electronic device.

3. The electronic device of claim 1, wherein the first contact electrically contacts with a left terminal of the external connector, and the second contact electrically contacts with a ground (GND) terminal of the external connector, when the external connector contacts.

4. The electronic device of claim 3, wherein the first contact maintains a pull-up state when the external material does not contact.

5. The electronic device of claim 4, wherein the first contact has a predetermined range of floating voltage, when at least one of the moisture and the foreign substance contacts.

6. The electronic device of claim 4, wherein the first contact has a ground level of voltage, when the external connector contacts.

7. The electronic device of claim 1, wherein the circuit comprises:

a first comparator that compares a first signal from the first contact with a predetermined first threshold value to generate the first comparison signal; and a second comparator that compares a second signal from the second contact with a predetermined second threshold value to generate the second comparison signal.

8. The electronic device of claim 7, wherein the circuit further comprises a logical element that receives the first comparison signal generated in the first comparator and the second comparison signal generated in the second comparator and performs a logical OR calculation of the first comparison signal and the second comparison signal to generate the third signal.

9. The electronic device of claim 8, wherein the processor is further configured to determine whether the external material is at least one of the moisture, the foreign substance and the external connector according to a logic state of the third signal output from the logical element.

10. The electronic device of claim 7, wherein the first threshold value is set to a value higher than a floating voltage occurring as a result of the moisture or the foreign substance.

11. The electronic device of claim 7, wherein the second threshold value is set to a value lower than a floating voltage occurring as a result of the moisture or the foreign substance.

12. The electronic device of claim 7, wherein the first comparator generates a first comparison signal that defines a logic state high, when the first signal is higher than the first threshold value, the second comparator generates a second comparison signal that defines a logic state low, when the second signal is lower than the second threshold value, the logical element receives an input of the first comparison signal and the second comparison signal to generate a third signal that defines a logic state high, and the processor executes instructions that determines whether the external material is at least one of the moisture and the foreign substance, when the third signal is in a logic state high.

13. The electronic device of claim 7, wherein the first comparator generates a first comparison signal that defines a logic state low, when the first signal is lower than the first threshold value, the second comparator generates a second comparison signal that defines a logic state low, when the second signal is lower than the second threshold value, the logical element receives an input of the first comparison signal and the second comparison signal to generate a third signal that defines a logic state low, and the processor executes instructions that determines whether the external material is the external connector, when the third signal is in a logic state low.

14. The electronic device of claim 1, further comprising a memory that stores an operation table that determines a kind of the external material that contacts with the hole according to a logic state of the third signal input to the processor, wherein the processor executes instructions that determines whether the external material is at least one of the moisture, the foreign substance and the external connector by referencing the operation table, when the third signal is input.

15. A method of preventing an electronic device from erroneously recognizing insertion of an external connector into a connector, the method comprising:

generating a first comparison signal by comparing a first signal that has occurred by an electrical contact of a first contact provided in the connector and an external material with a first threshold value;

generating a second comparison signal by comparing a second signal that has occurred by an electrical contact of a second contact provided in the connector and the external material with a second threshold value;

generating a third signal based on at least a portion of the first comparison signal and the second comparison signal; and determining whether the external material is at least one of moisture, a foreign substance and the external connector based on the third signal.

16. The method of claim 15, wherein the first threshold value is set to a value higher than a floating voltage occurring by the moisture or the foreign substance.

17. The method of claim 15, wherein the second threshold value is set to a value lower than a floating voltage occurring by the moisture or the foreign substance.

18. The method of claim 15, wherein generating a first comparison signal comprises generating a first comparison signal that defines a logic state high, when the first signal is higher than the first threshold value, generating a second comparison signal comprises generating a second comparison signal that defines a logic state low, when the second signal is lower than the second threshold value, generating a third signal comprises generating a third signal that receives an input of the first comparison signal and the second comparison signal to define a logic state high, and determining whether the external material is at least one of the moisture, the foreign substance, and the external connector comprises determining that the external material is at least one of the moisture and the foreign substance, when the third signal is in a logic state high.

19. The method of claim 15, wherein generating a first comparison signal comprises generating a first comparison signal that defines a logic state low, when the first signal is lower than the first threshold value, generating a second comparison signal comprises generating a second comparison signal that defines a logic state low, when the second signal is lower than the second threshold value, generating a third signal comprises generating a third signal that receives an input of the first comparison signal and the second comparison signal to define a logic state low, and determining whether the external material is at least one of the moisture, the foreign substance, and the external connector comprises determining that the external material is the external connector, when the third signal is in a logic state low.

20. The method of claim 15, wherein determining whether the external material is at least one of the moisture, the foreign substance, and the external connector comprises determining whether the external material is at least one of the moisture, the foreign substance, and the external connector by referencing an operation table stored in a memory.

* * * * *